US008522461B2

(12) United States Patent
Kirian

(10) Patent No.: US 8,522,461 B2
(45) Date of Patent: Sep. 3, 2013

(54) LIFT AND GRADE CONTROL APPARATUS FOR TRACTOR TRENCHER

(76) Inventor: Dennis Kirian, Tiffin, OH (US)

( * ) Notice: Subject to any disclaimer, the term of this patent is extended or adjusted under 35 U.S.C. 154(b) by 309 days.

(21) Appl. No.: 12/631,580

(22) Filed: Dec. 4, 2009

(65) Prior Publication Data

US 2010/0139131 A1 Jun. 10, 2010

Related U.S. Application Data

(60) Provisional application No. 61/119,786, filed on Dec. 4, 2008.

(51) Int. Cl.
*E02F 3/28* (2006.01)

(52) U.S. Cl.
USPC ..... 37/352

(58) Field of Classification Search
USPC ..... 37/332, 462, 464, 352–362, 380; 474/72, 152, 155; 30/383; 83/830
See application file for complete search history.

(56) References Cited

U.S. PATENT DOCUMENTS

| | | | | |
|---|---|---|---|---|
| 3,044,194 | A * | 7/1962 | Balkheimer | 37/348 |
| 3,266,179 | A * | 8/1966 | Golden | 37/355 |
| 3,575,006 | A | 4/1971 | Rugroden | |
| 4,142,817 | A | 3/1979 | Lazure | |
| 4,244,123 | A | 1/1981 | Lazure | |
| 4,750,280 | A | 6/1988 | Daline | |
| 4,833,797 | A * | 5/1989 | Slunecka et al. | 37/352 |
| 5,813,151 | A * | 9/1998 | Stephens et al. | 37/352 |
| 5,975,804 | A | 11/1999 | Bockman | |
| 6,351,900 | B1 * | 3/2002 | DeWind | 37/362 |
| 6,415,532 | B1 * | 7/2002 | Bricko et al. | 37/361 |

* cited by examiner

*Primary Examiner* — Robert Pezzuto
(74) *Attorney, Agent, or Firm* — The Van Winkle Law Firm; R. Brian Johnson

(57) ABSTRACT

A mechanical assembly controls the position of a trencher attached to a tractor and includes a positioning arm attached to the tractor at one end and the trencher at an opposite end. The positioning arm levers the trencher about a single fulcrum point on the positioning arm. A first lift cylinder has a base end connected to the tractor and an extendible end connected to the first positioning arm at the single fulcrum point. The positioning arm pivots about the tractor to move the trencher in response to the lift cylinder. Grade control cylinders are also attached to the positioning arm and the trencher to control the angular position of the trencher in relation to the ground below.

20 Claims, 5 Drawing Sheets

LIFT AND GRADE CONTROL APPARATUS FOR TRACTOR TRENCHER

CROSS REFERENCE TO RELATED APPLICATION

This application claims priority to related U.S. Provisional Patent Application Ser. No. 61/119,786 filed on Dec. 4, 2008, which is incorporated by reference as if fully set forth herein.

FIELD OF THE INVENTION

The invention relates to a mechanical assembly for controlling the lift height and the angular position of a trencher attached to a tractor.

BACKGROUND OF THE INVENTION

Many underground installations require the completion of digging operations prior to installing pipes, drains, tile equipment, and the like. The digging is often completed with a trencher, a specialized digging apparatus that often includes a chain or some other kind of plowing instrument to break through the ground. The trencher accomplishes just what its name implies—it leaves behind a trench of known size into which numerous kinds of tile drainage or other materials are installed. Trenchers come in a multitude of sizes with various kinds of accessories. While some models are integral with a large piece of construction equipment, one of the most popular kinds of trenchers is releasably attached to a tractor that pulls the trencher. The trencher attaches to the tractor for not only stability and mobility purposes, but the trencher also connects to the tractor's power systems via a transmission box and hydraulic attachments. In one embodiment, the transmission box translates power from the tractor's engine to a motor in the trencher. The motor drives the trencher's digging chain that breaks up the earth to form the necessary trench.

One useful technology in detachable trenchers includes the hydraulic systems that allow the user to change the position of the trencher depending upon the installation at hand. Hydraulic cylinders connected between the tractor and the trencher engage the hydraulic fluid systems on the tractor. Controls allow the user to manipulate the hydraulic cylinders to lift the trencher for digging depth adjustment or to rotate the trencher for angular adjustment.

The lifting and angular position controls have been the subject of prior efforts in the field of tractor-driven trenchers. U.S. Pat. No. 4,142,817 (Lazure 1971) shows hydraulic cylinders that adjust the tilt and vertical position of an attached plow. The cylinders are arranged along with mechanical linking segments to create parallelogram-shaped support structures. The cylinders are used to deform the parallelogram in various directions to move the trencher to an appropriate position for the task at hand.

U.S. Pat. No. 4,750,280 (Dalaine 1988) describes a trencher attachment that tilts about the back tire of the associated tractor pulling the trencher. The trencher moves vertically via a connection to a sleeve that pulls the digging mechanism up and down.

U.S. Pat. No. 5,975,804 (Bockman 1999) discloses a tile plow positioned by front and rear hydraulic cylinders. When the hydraulic cylinders are retracted, a beam is lowered such that the tile plow moves to the lowered plowing position. When the hydraulic cylinders are extended, the beam raises up so that the tile plow moves to a raised transport position. Again, hydraulic cylinders perform the work of moving the trencher to the necessary position.

U.S. Pat. No. 3,575,006 (Rugroden 1971) utilizes arms that are connected to a tractor mount through a pair of hydraulic cylinder and piston members respectively. The piston and cylinder mechanisms are secured pivotally to a fixed arm at upper ends to move the trencher up off the ground or down into a hole.

BRIEF SUMMARY OF THE INVENTION

In one embodiment, a mechanical assembly controls the position of a trencher attached to a tractor and includes a first single piece positioning arm attached to the tractor at one end and the trencher at an opposite end. The positioning arm levers the trencher about a single fulcrum point on the positioning arm. A first lift cylinder has a base end connected to the tractor and an extendible end connected to the first positioning arm at the single fulcrum point. In this regard, the first lift cylinder is the sole supporting structure holding up the positioning arm at the single fulcrum point. The first positioning arm pivots about a first connection to the tractor to raise and lower the trencher in response to extension and refraction of the first lift cylinder. In this embodiment, a corresponding second positioning arm and second lift cylinder are positioned an opposite side of the trencher from the first assembly.

The apparatus also includes a machination for controlling the angular position of a trencher attached to a tractor. In this embodiment, a grade cylinder having a first end and a second end is attached to the positioning arm and controls the trencher angle at a point on the trencher above the positioning arm.

The assembly for controlling the lift height and the angular position of a trencher may be attached to a pair of uprights connected to the tractor. A pair of positioning arms are each connected to a pair of uprights and allowed to pivot about the respective uprights. The positioning arms control the lifting height and the attitude, or tilt, of the trencher in response to attached lift cylinders and grade cylinders, respectively.

In yet another variation, an assembly for controlling the position of a trencher attached to a tractor includes a first upright connected to the tractor, a first positioning arm pivotally connected to the first upright and the trencher, and a first lift cylinder connected to the first upright and the first positioning arm. The upright, the positioning arm, and the lift cylinder form a triangular support mechanism with the lift cylinder being an adjustable length hypotenuse of the triangular support mechanism. Lengthening the hypotenuse lifts the trencher and shortening the hypotenuse lowers the trencher.

DETAILED DESCRIPTION

Figure 1:
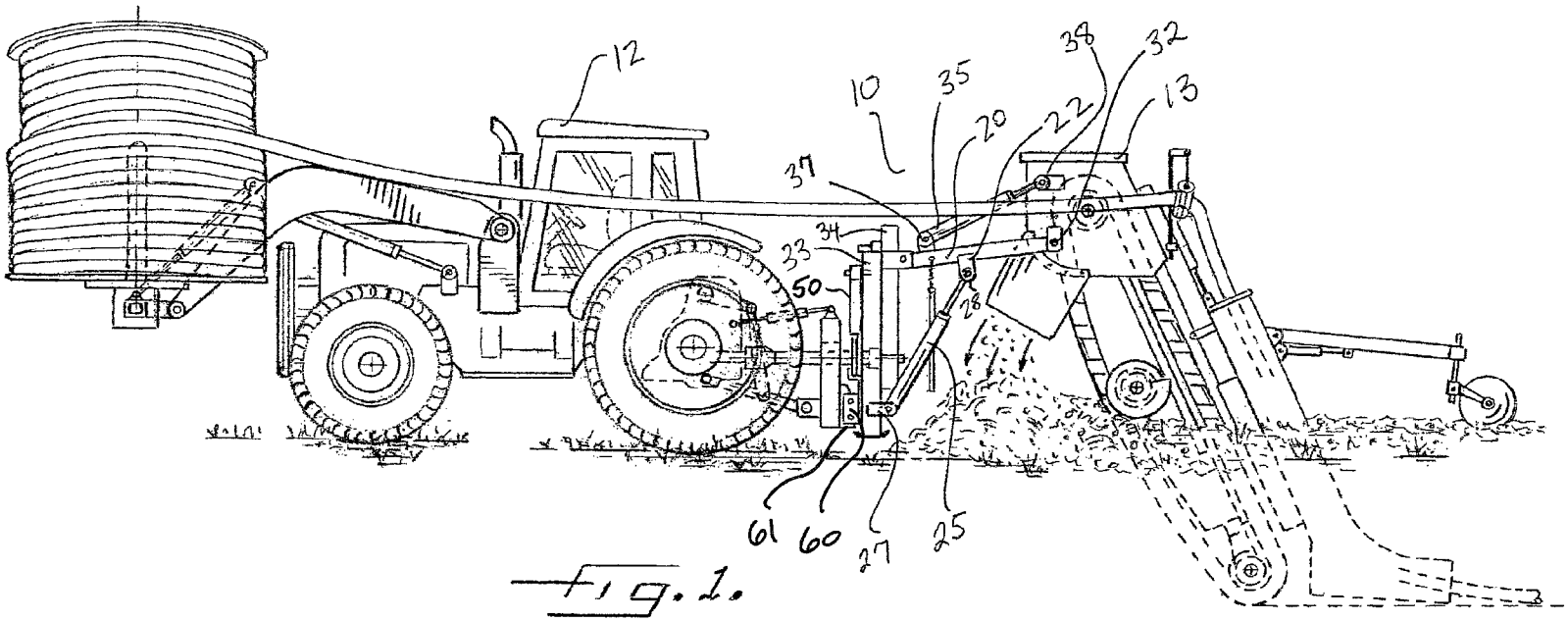
FIG. 1 is a perspective view of a trencher attached to a tractor and controlled by the mechanical assembly described herein.

A trencher (13) attached to a tractor (12) is useful for preparing the ground for many kinds of installations such as conduits, piping, tile drainage, and the like. As shown in FIG. 1, the tractor may also include a means of distributing material to be buried in a trench created by the trencher (13). In the figures at hand, a coil of drainage tubing extends across the tractor (12) and the trencher (13) for distribution through the delivery chute into the trench formed by the equipment.

For optimal use of the trencher (13), the user needs to be able to control the height to which the digging chain on the trencher engages the ground for proper depth control. The user further needs to adjust the angle at which the trencher (13) digs for additional depth control and to accommodate multiple kinds of soil conditions. Adjusting the angle and height of the trencher (13) also enables the user to remove the trencher (13) from the ground and drive the tractor (12) over the ground with the trencher (13) attached but not plowing.

In one embodiment of the apparatus disclosed herein, a combination of mechanical posts, or uprights, hydraulic cylinders and pistons, and pivoting linkages connecting the parts allow for an efficient lifting arrangement and angular adjustment for a trencher (13) that attaches to a tractor (12). For purposes herein, the term hydraulic cylinder is used as known in the art of hydraulics and includes all the necessary accompanying parts such as the cylinder barrel, the cylinder head, the piston, the piston rod, and the like. Standard hydraulic systems can be attached to the mechanical support assembly described herein to accomplish the goals of controlling both the angular and vertical position of a trencher attached to a tractor.

A mechanical support assembly (10) shown in FIGS. 1-3 uses a lever system to adjust the position of the trencher (13) in relation to the associated tractor (12) and the ground below. This lever system is more efficient and conserves energy in a way that has not been shown previously. The basics of the lever system include a pair of single piece positioning arms (20, 40) supported at respective fulcrum point (22A, 22B) by a respective lift cylinder (25, 26). The positioning arms (20, 40) pivot about a respective connection (31, 32) to the tractor, and the trencher (13) pivots about a connection to the positioning arms (20, 40). In a full installation, a pair of positioning arms (20, 40) are located opposite each other with the trencher (13) between the two arms. Corresponding lift cylinders (25, 26) are connected to each respective positioning arm to support the positioning arm at a respective fulcrum point (22A, 22B) on the respective positioning arm (20, 40). By raising and lowering the lift cylinders (25, 26) at the respective fulcrum points (22A, 22B) on the positioning arms (20, 40), the assembly (10) can move the trencher into and out of position with less work required. As the lift cylinders move respective positioning arms, the positioning arms pivot at a respective connection point (31, 32) proximate the tractor. This pivoting allows the positioning arms (20, 40) to raise and lower the trencher (13).

The assembly may further include grade control cylinders (35, 36), which are hydraulic cylinders attached to the respective positioning arms (20, 40) at a lower ends (37A, 37B) and attached to the trencher at respective points (38A, 38B) above the positioning arms (20, 40). The grade cylinders (35, 36) adjust the angle of the trencher by hydraulically retracting and extending to rotate the trencher (13). This rotation adjusts the angle, or attitude, of the trencher relative to the connection points (32A, 32B) at respective ends of the positioning arms.

The grade cylinders (35, 36) may also be used to position the trencher (13) in relation to the above-described lever system. By retracting the grade cylinders (35, 36), the assembly is capable of translating the weight of the trencher closer to the respective fulcrum points (22) on the positioning arms (22A, 22B). The inventor does not wish to be limited to any one theory of operation, but by moving the weight of the trencher closer to the fulcrum point on the positioning arm, the lift cylinder requires less energy to move the trencher up and down. Accordingly, the mechanical support assembly disclosed herein allows for the grade control hydraulic cylinders and the lift cylinders to be used in conjunction with a pivoting positioning arm to provide an efficient range of motion for placing the trencher in the proper location. This location includes various digging depths, a vertical position, and a traveling position in which the trencher can be hauled above ground.

Figure 2A:
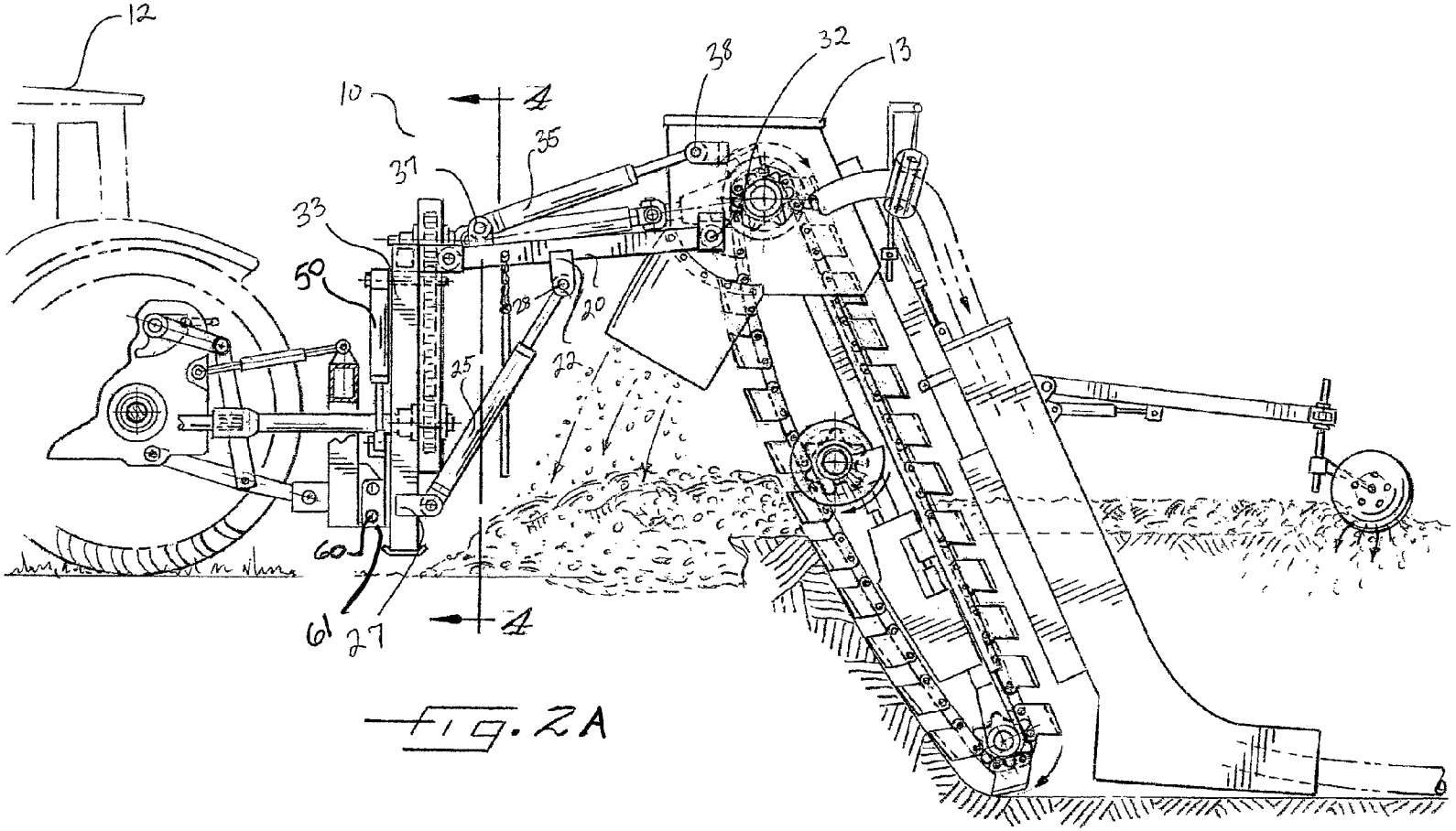
FIG. 2A is a left side cross-sectional and close-up view of the mechanical assembly controlling the position of a trencher attached to a tractor.
Figure 2B:
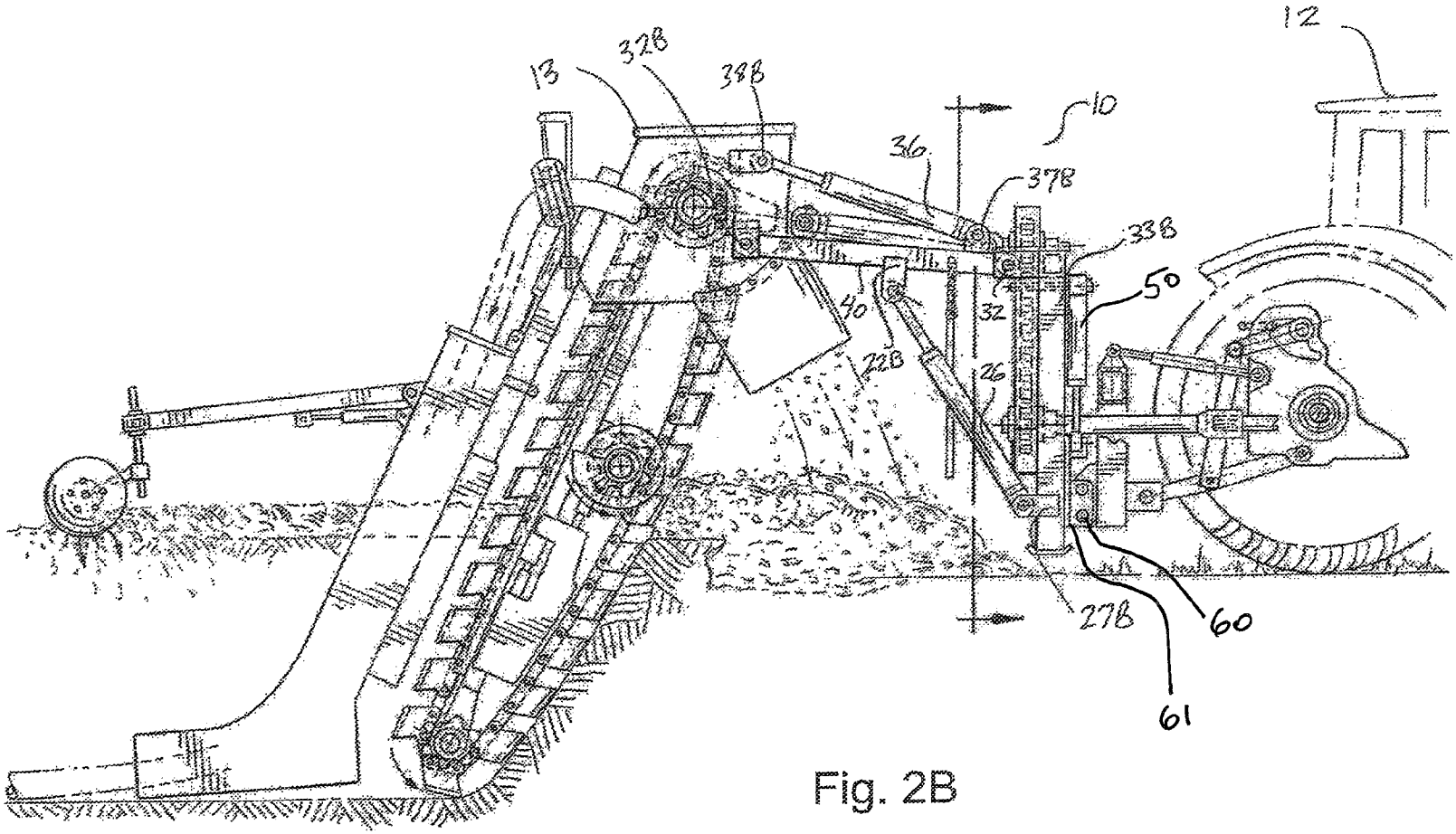
FIG. 2B is a right side cross-sectional and close-up view of the mechanical assembly controlling the position of a trencher attached to a tractor.
Figure 3:
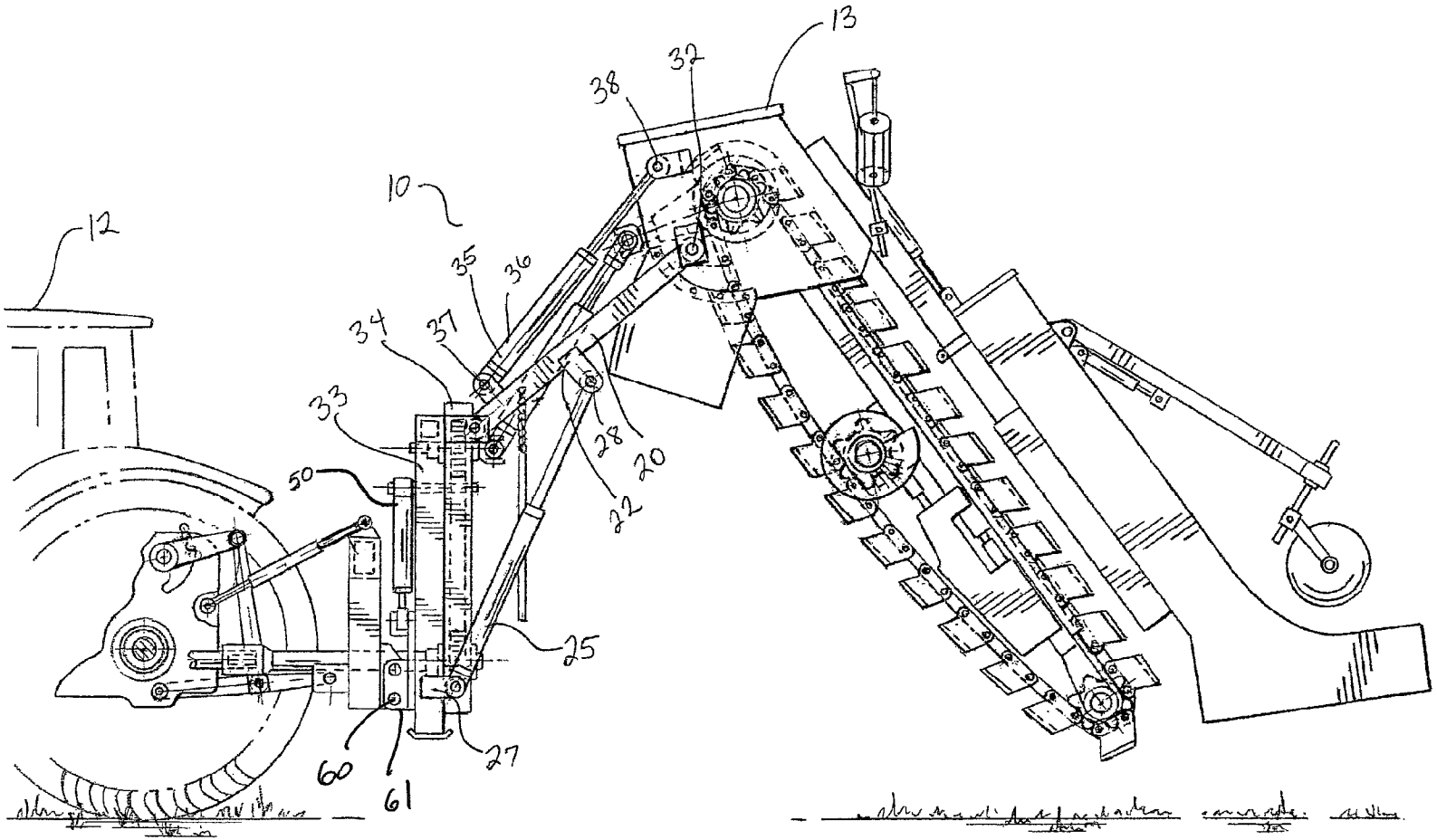
FIG. 3 is a cross-sectional view of the power transmission assembly and the position adjusting assembly associated with a trencher attached to a tractor.

In the embodiment of FIGS. 1-3, an assembly for controlling the position of a trencher attached to a tractor includes a first single-piece positioning arm (20) attached to the tractor (12) and the trencher (13). The first positioning arm levers the trencher about a single fulcrum point (22) on first positioning arm. This embodiment includes a first lift cylinder (25) having a base end (27) connected to the tractor and an extendible end (28) connected to a first positioning arm (20) at the single fulcrum point (22). The first positioning arm (20) pivots about a first connection (31) to the tractor to raise and lower the trencher in response to extension and retraction of the first lift cylinder. In contrast to other systems, the positioning arm (20) is of a single-piece construction, meaning without limitation, that the positioning arm is substantially consistent along its length and, in some embodiments, may not include multiple pieces or sections along that length. As noted in regard to the lever description above, the positioning arm may include a single fulcrum point to which a single support mechanism, such as a lift cylinder, connects. Without limiting the invention in any way, this embodiment may encompass configurations in which only one lower support is attached to the positioning arm at the fulcrum point. In other words, by implementing a lever system for lifting the trencher, multiple posts and linkages supporting the positioning arm may be avoided. Depending on the size of the trencher, the fulcrum point may be adjustable or may be at different places along the positioning arm for various trencher installations.

As noted above, the positioning arm may be allowed to pivot about a connection to the tractor in order to lift the trencher in response to the extension of the lift cylinder (or correspondingly lower the trencher in response to retraction of the lift cylinder). The pivoting connection to the positioning arm may be installed on an upright or post (34) that ultimately connects to the tractor.

Using an upright (34) to connect the trencher to the tractor may impart additional stability. In this embodiment, a base end (27) of a first lift cylinder (25) is attached to the tractor via a first upright (34). The opposite end (28) of the first lift cylinder (25) attaches to the positioning arm (20) as described above. The assembly may further include a first grade cylinder (35) having a first end (37) attached to the first positioning arm (20) (i.e., on top of the positioning arm) and a second end (38) attached to the trencher such that the trencher pivots about the first positioning arm.

In one implementation of the trencher assembly, the uprights, the positioning arms, and the cylinders are installed in corresponding pairs on either side of the trencher. Accordingly, an assembly for controlling the position of a trencher may include a second single-piece positioning arm attached to the tractor and the trencher opposite the first positioning arm, the positioning arms levering the trencher about respective oppositely positioned single fulcrum points on the first and second positioning arms. A second lift cylinder has a second base end connected to the tractor and a second extendible end connected to the second positioning arm at a single fulcrum point on the second positioning arm. As in the prior description, the second positioning arm pivots about a second connection to the tractor to raise and lower the trencher in response to extension and retraction of the second lift cylinder.

The trencher, therefore, rests between the positioning arms, which are part of respective lever systems for lifting each side of the trencher. In this sense, an assembly for adjusting the position of a trencher attached to a tractor includes a pair of uprights connected to the tractor and a pair of positioning arms connected to the uprights. Each positioning arm has a support end and an opposite end, and each positioning arm is pivotally connected to a respective upright at the support end and pivotally connected to the trencher at the opposite end.

The assembly further includes a pair of lift cylinders, each having a base end and an extendible end, wherein each lift cylinder is attached to a respective upright at the base end and attached to a respective positioning arm at the extendible end. A pair of grade cylinders may be attached to the positioning arms. Each grade cylinder has a first end and a second end, and each grade cylinder is attached to a respective positioning arm at the first end and attached to the trencher at the second end. The positioning arms control the lifting height and the attitude of the trencher in response to the extension of the lift cylinders and grade cylinders respectively.

One way to describe the trencher assembly that controls position is in a geometric sense. In this regard, the assembly includes a first upright (34) connected to the tractor, a first positioning arm (20) pivotally connected to the first upright and the trencher (13), and a first lift cylinder connected to the first upright and the first positioning arm. The upright, the positioning arm and the lift cylinder form a triangular support mechanism with the lift cylinder being an adjustable length hypotenuse of the triangular support mechanism. Lengthening the hypotenuse lifts the trencher and shortening the hypotenuse lowers the trencher. The triangle configuration adjusts the directional forces from weight of the trencher to ensure optimal efficiency in the use at hand.

Figure 4:
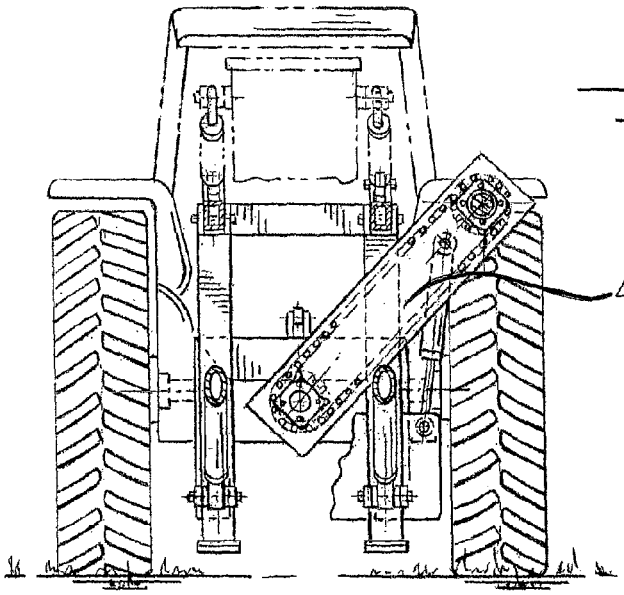
FIG. 4 is a rear view of a tractor and the tractor's power transmission box for connecting to a mechanical assembly that controls the position of a trencher to be connected to the tractor.
Figure 5A:
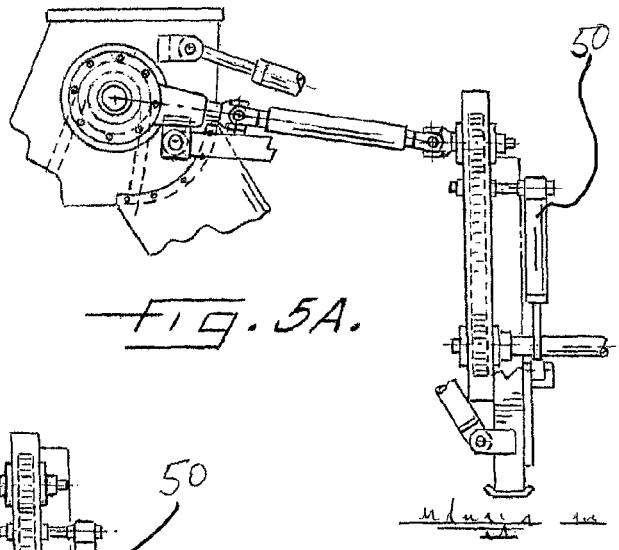
FIG. 5A is a cross sectional view of the drive train from the tractor lowering a hitch connection for attaching to a trencher in accordance with the disclosure herein.
Figure 5B:
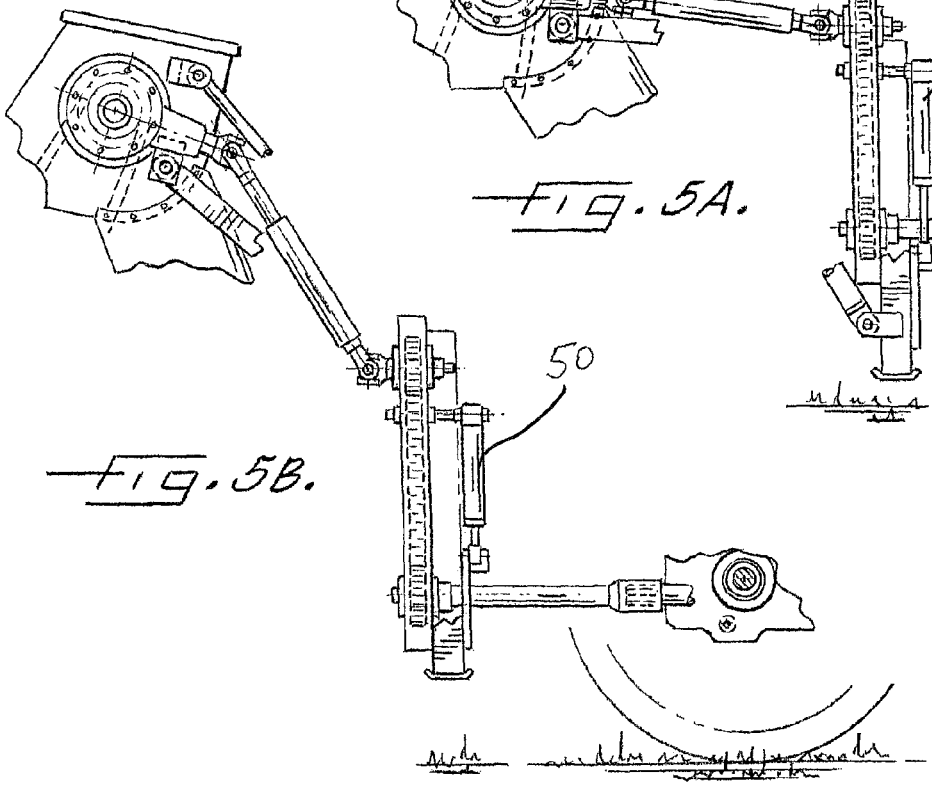
FIG. 5B is a cross sectional view of a drive train assembly for connecting to the power equipment that drives a trencher attached to the tractor.

The hydraulics and power requirements for accomplishing the goals of the above described assembly emanate from systems on the tractor. These are shown in FIGS. 4-5A. FIG. 4 includes the power transmission box on the tractor that drives the motor on the trencher. FIGS. 5A and 5B show an additional lift (50) from the back side of the tractor for further adjustment of the height of the trencher. As shown in FIG. 5A, the additional lift (50) controls the position of a hitch (60) that engages and disengages a hitch connection (61) on the tractor, allowing the trencher to be attached to the tractor as shown in FIG. 1 and detached from the tractor as shown in FIG. 4A.

The description herein uses terms in the broadest sense. The figures and the related description are exemplary only. The invention is further set forth in the following claims.

The invention claimed is:

1. An assembly for controlling the position of a trencher attached to a tractor, the assembly comprising:

a first single-piece positioning arm attached to the tractor and the trencher, said first positioning arm levering the trencher about a single fulcrum point on said first positioning arm;

a first lift cylinder having a base end connected to the tractor and an extendible end connected to said first positioning arm at said single fulcrum point;

a hitch configured to attach and detach the assembly from a tractor hitch connection such that the assembly is entirely removable from the tractor; and an additional lift connecting the assembly to said hitch, wherein said first positioning arm pivots about a first connection to the tractor to raise and lower the trencher in response to extension and retraction of said first lift cylinder.

2. An assembly according to claim 1, wherein said first lift cylinder is a sole support between ends of said first positioning arm.

3. An assembly according to claim 2, further comprising a first upright attached to the tractor and supporting said first positioning arm.

4. An assembly according to claim 3, wherein said base end of said first lift cylinder is attached to the tractor via said first upright.

5. An assembly according to claim 1, further comprising a first grade cylinder having a first end attached to said first positioning arm and a second end attached to the trencher such that the trencher pivots about said first positioning arm.

6. An assembly according to claim 1, further comprising:

a second single-piece positioning arm attached to the tractor and the trencher opposite said first positioning arm, said positioning arms levering the trencher about respective oppositely positioned single fulcrum points on the first and second positioning arms;

a second lift cylinder having a second base end connected to the tractor and a second extendible end connected to said second positioning arm at a single fulcrum point on said second positioning arm, wherein said second positioning arm pivots about a second connection to the tractor to raise and lower the trencher in response to extension and retraction of said second lift cylinder.

7. An assembly for controlling the angular position of a trencher attached to a tractor, the assembly comprising:

a first single-piece positioning arm extending between the tractor and the trencher, wherein the first positioning arm is pivotally connected to the tractor at a first support end and pivotally connected to the trencher at an opposite end;

a first grade cylinder having a first end attached to said positioning arm proximate the tractor and a second end attached to the trencher at a connection point above said positioning arm;

a hitch configured to attach and detach the assembly from a tractor hitch connection such that the assembly is entirely removable from the tractor; and an additional lift connecting the assembly to said hitch.

8. An assembly according to claim 7, further comprising a first upright attached to the tractor and supporting said first positioning arm.

9. An assembly according to claim 7, further comprising a first lift cylinder having a first base end attached to said first upright and a first extendible end attached to said first positioning arm such that said first positioning arm raises and lowers the trencher in response to the extension and retraction of said first lift cylinder.

10. An assembly according to claim 9, further comprising:

a second single-piece positioning arm attached to the tractor and the trencher opposite said first positioning arm, said positioning arms levering the trencher about respective oppositely positioned single fulcrum points on the first and second positioning arms;

a second lift cylinder having a second base end connected to the tractor and a second extendible end connected to said second positioning arm at a single fulcrum point on said second positioning arm, wherein said second positioning arm pivots about a second connection to the tractor to raise and lower the trencher in response to extension and retraction of said second lift cylinder;

a second grade cylinder having a cylinder end attached to said positioning arm proximate the tractor and a second cylinder end attached to the trencher at a second connection point above said second positioning arm.

11. An assembly for adjusting the position of a trencher attached to a tractor, the assembly comprising:

a pair of uprights connected to the tractor;

a pair of positioning arms, each having a support end and an opposite end, wherein each positioning arm is pivotally connected to a respective upright at the support end and pivotally connected to the trencher at the opposite end;

a pair of lift cylinders, each having a base end and an extendible end, wherein each lift cylinder is attached to a respective upright at the base end and attached to a respective positioning arm at the extendible end;

a pair of grade cylinders, each having a first end and a second end, wherein each grade cylinder is attached to a respective positioning arm at the first end and attached to the trencher at the second end; and a hitch configured to attach and detach the assembly from a tractor hitch connection such that the assembly is entirely removable from the tractor; and an additional lift connecting the assembly to said hitch, wherein the positioning arms control the lifting height and the attitude of the trencher in response to the extension of said lift cylinders and grade cylinders respectively.

12. An assembly according to claim 11, wherein said lift cylinders lever the trencher about respective single fulcrum points on each positioning arm.

13. An assembly according to claim 11, wherein said grade cylinders control the distribution of the weight of the trencher across said positioning arms.

14. An assembly according to claim 11, wherein said grade cylinders adjust the angle at which the trencher approaches the ground.

15. An assembly according to claim 14, wherein the angle is substantially vertical.

16. An assembly for controlling the position of a trencher attached to a tractor, the assembly comprising:

a first upright connected to the tractor;

a first positioning arm pivotally connected to the first upright and the trencher;

a first lift cylinder connected to the first upright and the first positioning arm, wherein said upright, said positioning arm and said lift cylinder form a triangular support mechanism with the lift cylinder being an adjustable length hypotenuse of the triangular support mechanism;

a hitch configured to attach and detach the assembly from a tractor such that the assembly is entirely removable from the tractor; and an additional lift connecting the assembly to said hitch on the tractor, wherein lengthening the hypotenuse lifts the trencher and shortening the hypotenuse lowers the trencher.

17. An assembly according to claim 16, further comprising a first grade cylinder attached between said first positioning arm and the trencher for adjusting the angle at which the trencher approaches the ground.

18. An assembly according to claim 16, wherein said first lift cylinder is the sole fulcrum for levering the trencher with said first positioning arm.

19. An assembly according to claim 16, further comprising a second triangular support mechanism positioned on the opposite side of the trencher, said second triangular support mechanism comprising a second upright, a second positioning arm pivotally connected to said second upright and the trencher, and a second lift cylinder connected to the second upright and the trencher.

20. An assembly according to claim 19, wherein said first and second triangular support mechanisms move uniformly to adjust the position of the trencher.

* * * * *